US007681390B2

(12) United States Patent
Wust et al.

(10) Patent No.: US 7,681,390 B2
(45) Date of Patent: Mar. 23, 2010

(54) SPINDLE WITH INJECTOR DUCT AND PIECING METHOD FOR AN AIRJET SPINNING MACHINE

(75) Inventors: Olivier Wust, Seuzach (CH); Herbert Stalder, Kollbrunn (CH)

(73) Assignee: Maschinenfabrik Rieter AG, Winterthur (CH)

( * ) Notice: Subject to any disclaimer, the term of this patent is extended or adjusted under 35 U.S.C. 154(b) by 332 days.

(21) Appl. No.: 11/659,519

(22) PCT Filed: Jul. 15, 2005

(86) PCT No.: PCT/CH2005/000410

§ 371 (c)(1),
(2), (4) Date: Aug. 27, 2007

(87) PCT Pub. No.: WO2006/017948

PCT Pub. Date: Feb. 23, 2006

(65) Prior Publication Data

US 2008/0072562 A1 Mar. 27, 2008

(30) Foreign Application Priority Data

Aug. 20, 2004 (CH) ..... 1372/04

(51) Int. Cl.
*D01H 4/02* (2006.01)

(52) U.S. Cl. ..... 57/350; 57/403

(58) Field of Classification Search ..... 57/315, 57/350, 403
See application file for complete search history.

(56) References Cited

U.S. PATENT DOCUMENTS 7,464,529 B2 * 12/2008 Stahlecker et al. ..... 57/263
2003/0101710 A1 * 6/2003 Wust et al. ..... 57/328

FOREIGN PATENT DOCUMENTS

EP 0 853 149 A 7/1998
JP 2001 295143 A 10/2001
WO WO 2005047580 A1 * 5/2005
WO WO 2006027216 A1 * 3/2006

OTHER PUBLICATIONS

Patent Abstracts of Japan vol. 2002, No. 02, Apr. 2, 2002 (Not available).
International Search Report.

* cited by examiner

*Primary Examiner*—Shaun R Hurley
(74) *Attorney, Agent, or Firm*—Dority & Manning, P.A.

(57) ABSTRACT

A spindle of an airjet spinning machine for guiding back the free yarn end after an interruption in a spinning process is disclosed. The spindle contains an injector duct in the immediate vicinity of the spindle orifice. To guide the free yarn end back after an interruption, compressed air is admitted through the injector duct and generates a suction action at the spindle end. After the yarn end has been guided back level with the entrance of the injector duct the yarn end is blown out of the spindle orifice by the compressed air.

20 Claims, 2 Drawing Sheets

SPINDLE WITH INJECTOR DUCT AND PIECING METHOD FOR AN AIRJET SPINNING MACHINE

FIELD OF THE INVENTION

The present invention relates to a spindle for an airjet spinning machine and a method for piecing after a yarn break in a spinning process.

BACKGROUND OF THE INVENTION

The present invention relates to the field of airjet spinning machines. Airjet spinning machines have a multiplicity of spinning stations. In each spinning station, a yarn is spun from a longitudinal fiber structure. In this case, the longitudinal fiber structure is first refined by drafting, a process in which the fiber quantity per unit length is reduced. The refined fiber composite is then spun into a yarn by imparting a twist.

Yarn breaks, of course, cannot be prevented and result in an interruption of the spinning process. To resume the spinning process, the free yarn end which results from the yarn break is drawn out opposite to the spinning direction (upstream) beyond the twist-imparting point and is positioned. The initial region of the fiber composite, which overlaps the free yarn end after the free yarn end is positioned, is subsequently connected to the free yarn end by imparting a twist in the spinneret. The spinning operation is thus resumed.

The thread take-off duct, also called a yarn duct or spindle duct, must have specific dimensions for spinning and structural reasons. The length L of the spindle duct has a value in the range of about 60 mm to 80 mm. The diameter $d_E$ of the entry orifice of the spindle duct has a value in the range of about 0.8 mm to 1.2 mm. The diameter $d_A$ of the exit orifice of the spindle duct has a value of about 2.0 mm or less. The diameter $d_A$ of the exit orifice of the spindle duct typically has a value that is greater than the value of the diameter $d_E$ of the entry orifice of the take-off duct. The above mentioned dimensions of the spindle duct define a thin and long bore. Because of these dimensions, the operation of guiding the free yarn end back in the spindle duct is very awkward.

A known method and device for repiecing provides an ejector duct through which compressed air is injected for the reintroduction of the yarn. This results in an injection air stream acting "upstream." A spinning device which includes an injector duct is also disclosed in which, by the admission of compressed air, the thread take-off duct can be moved away in order to make it easier to reintroduce the yarn. However, the arrangement of these aforementioned injector ducts has not yet led to fully satisfactory results.

An object of the present invention is to provide a method and a spindle for carrying out the method, which, after an interruption in a spinning process, allow the yarn to be guided back reliably and accurately to produce a piecer. The spindle for carrying out the method is to have a simple configuration in structural terms.

SUMMARY OF THE INVENTION

A summary of exemplary embodiments of the present invention will be set forth here. Using the description provided herein, one skilled in the art will understand that additional exemplary embodiments are within the scope of the present invention.

Certain exemplary embodiments of the present invention include a spindle with an injector duct and yarn guide duct.

The supply of compressed air by the injector duct into the spindle causes the following results:

i) a suction action arises at the end of a yarn guide duct, with the result that it becomes substantially easier to guide the yarn end back; and ii) after the yarn end has come level with the injector duct, it is blown out through the spindle orifice by the compressed air.

In one exemplary embodiment, the present invention provides a spindle for a spinning station of an air jet spinning machine. The spindle includes a yard guide duct having a spindle aperture and an end. The spindle further includes an injector duct configured to inject compressed air in the vicinity of the spindle aperture. The injection of the compressed air creates a suction action at the end of the yarn guide duct. This suction action facilitates the guiding back of the free yarn end.

An alternative exemplary embodiment of the present invention provides a method for piecing after an interruption in a spinning process in a spindle with a yarn guide duct having a spindle aperture and an end in which a free yarn end is guided in reverse through the spindle aperture. Compressed air is injected into the vicinity of the spindle aperture. This creates a suction action at the end of the yard guide duct. The suction action causes the free yard end to be guided in reverse. In a variation of this exemplary embodiment, the injection of compressed air blows the free yarn end out of the spindle aperture.

A spindle for an airjet spinning machine is thereby provided which improves greatly the process of piecing after a yarn break. The spindle is also capable of being produced in a simple way.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE DRAWINGS

Objects and advantages of the invention will be set forth in the following description, or may be apparent from the description, or may be learned through practice of the invention. Attention should expressly be drawn to the fact, however, that the invention and the idea of the invention are not restricted to the embodiments shown in the examples.

Figure 1:
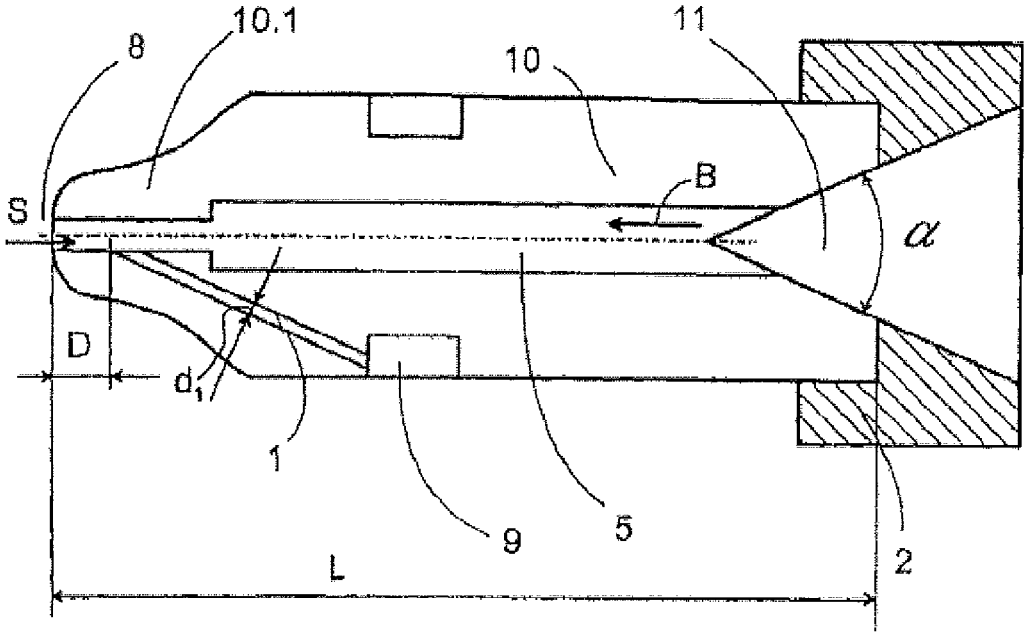
FIG. 1 shows a basic illustration of a spindle with an arrangement according to an exemplary embodiment of the present invention.

FIG. 1 shows a basic illustration, not true to proportion, of an exemplary embodiment of a rotationally symmetrical spindle 10 with a yarn take-off duct 5 according to the present invention. S designates the spinning direction in a normal spinning operation and B designates the guiding-back direction of the free yarn end to eliminate the thread break. On the end 11 of the spindle 10, a spindle socket 2 with a conical orifice at an angle $\alpha$ is arranged. In spindle 10 an injector duct 1 is provided, the orifice of which is arranged near the spindle aperture 8 to make it easier to guide back the free yarn end. A groove 9 is lathe-turned out for the supply of compressed air. The diameter d1 of the cylindrically designed injector duct 1 has a value in the range of about 0.5 mm to 0.7 mm. Preferably, the diameter d1 has a value of about 0.6 mm. The distance D between the spindle aperture and the entrance of the injector duct has a value of about 8 mm or less.

Figure 1A:
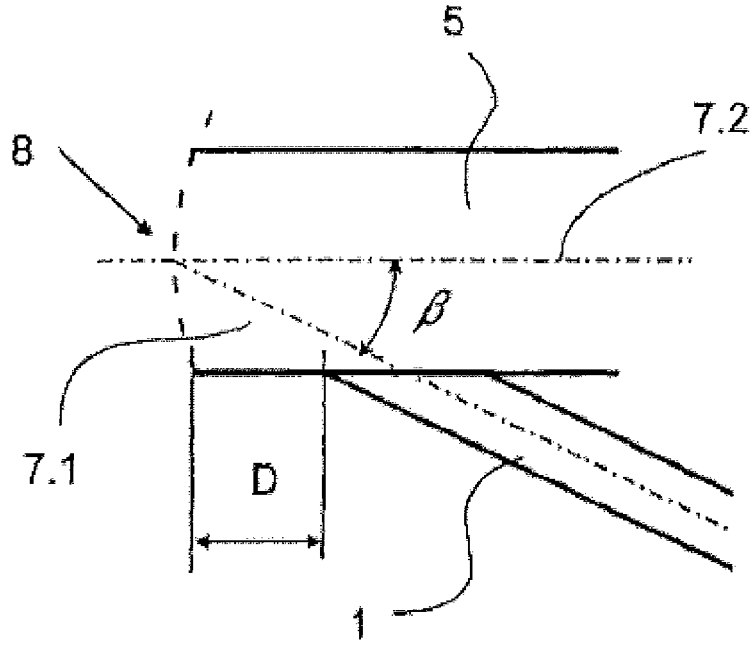
FIG. 1*a* shows a view of an exemplary arrangement of an injector duct.

FIG. 1*a* shows an exemplary embodiment of the arrangement of the injector duct 1. The axis 7.1 of the injector duct 1 and the axis 7.2 of the yarn duct 5 intersect approximately at the spindle aperture 8. The angle of inclination B of the two abovementioned axes preferably has a value in the range of about 5° to 20°. In this exemplary embodiment, the following optimal values are obtained for the distance D. The distance D preferably has a value of about 5 mm or less. The distance D more preferably has a value in the range of about 2 mm to 3 mm. The relation between the distance D and the length L of the spindle is such that the distance D has a value less than the distance L. The distance D may have a value of about 8 mm or less. However, the distance D preferably has a value of about 5 mm or less.

Figure 2:
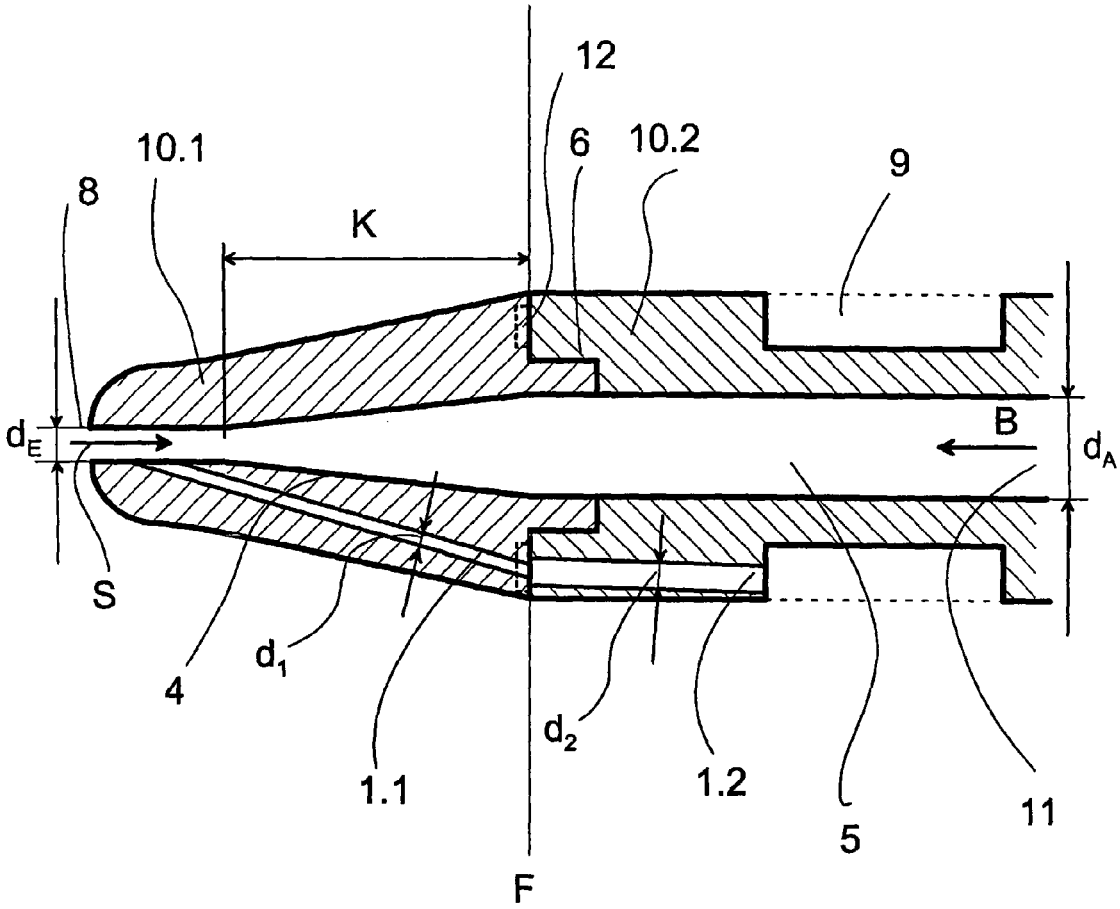
FIG. 2 shows the structural configuration of a spindle with an injector duct according to an exemplary embodiment of the present invention

FIG. 2 shows a spindle 10 configured according to an exemplary embodiment of the present invention. The spindle 10 is formed by two parts 10.1 and 10.2. Part 10.1 is also called a spindle tip 10.1 and part 10.2 is also called a spinning tube 10.2. The spindle tip 10.1 and the spinning tube 10.2 are connected via a fit 6. The injector duct 1 has a first injector tube 1.1 and a second injector tube 1.2 which are inclined axially with respect to one another and which differ from one another in their respective diameters $d_1$ and $d_2$. The diameter $d_2$ has a value that is greater than the value of diameter $d_1$. The diameter $d_2$ has a value in the range of about 1.0 mm to 2.0 mm.

The different dimensioning is due to manufacturing requirements. The spinning tube 10.2 with the larger diameter $d_2$ can be machined more simply and therefore produced more cost-effectively. Furthermore, both first and second injector tubes 1.1 and 1.2 can be produced relatively simply as bores 1.1 and 1.2 from the parting plane F.

The diameter $d_E$ of the entry orifice and the diameter $d_1$ define a ratio $$\frac{d_1}{d_E}.$$

The ratio $$\frac{d_1}{d_E}$$

preferably has a value in the range of about 0.3 to about 0.8.

The spindle tip 10.1 and the spinning tube 10.2 are preferably adhesively bonded to one another for connection. In certain embodiments of the present invention, the spindle tip 10.1 and/or the spinning tube 10.2 has an annular gap 12 in the region of connection. This is to prevent having to arrange the axes of the injection tubes 1.1 and 1.2 of the injector duct exactly in alignment.

Additionally or alternatively to the above dimensioning, the yarn duct 5 may have a conical shape 4 within the spindle tip 10.1. The conical shape 4 is determined by the cone length K and the diameters $d_A$ and $d_E$. K typically has a value in the range of about 13 mm to 27 mm.

The piecing method involves the following steps. The free yarn end of the yarn is initiated in reverse by an actuation of the supply of compressed air into the groove 9. According to Bernoulli's law, a vacuum or a suction action arises at the spinning socket 2, so that the yarn end can move through the yarn duct 5 beyond the spindle aperture 8. The compressed air admitted into the injector duct 1 or injector tubes 1.1 and 1.2 has the effect of blowing the yarn end out of the spindle aperture 8. As a result, the guiding back of the yarn end is assisted.

The teachings according to the exemplary embodiments of the present invention discussed above may be implemented by a free combination of the structural configurations and dimensions explained above and depicted in FIGS. 1, 1*a* and 2. For example, the diameters of the injector tubes 1.1 and 1.2 are largely independent of the configuration of the cone of the thread take-off duct 5 or of the cone of the spindle socket 2.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

The invention claimed is:

1. A spindle for a spinning station of an air jet spinning machine, comprising:

a yarn guide duct having a spindle aperture and an end;

an injector duct configured to inject compressed air in the vicinity of the spindle aperture without movement of the yarn guide duct;

wherein upon injection of the compressed air, a suction action arises at the end of said yarn guide duct, the suction action facilitating the guiding back of a yarn end.

2. The spindle of claim 1, wherein said injector duct is located at a distance D from said spindle aperture, the distance D having a value of about 8 mm or less.

3. The spindle of claim 1, wherein said spindle defines an axis and said injector duct defines an axis, the axis of said injector duct being inclined at an angle β with respect to the axis of said spindle, the angle β having a value in the range of about 5° to about 20°.

4. The spindle of claim 3, wherein the axis of said spindle intersects the axis of said injector duct in said spindle aperture.

5. The spindle of claim 1, wherein the yarn guide duct has a conical shape downstream of said injector duct.

6. The spindle of claim 1, wherein said injector duct comprises a first injector tube and a second injector tube and said spindle comprises a spindle tip and a spinning tube operatively connected to said spinning tip;

said spindle aperture and said first injector tube are located in said spindle tip and said second injector tube is located in said spinning tube.

7. The spindle of claim 6, wherein said first injector tube has a diameter $d_1$ and said second injector tube has a diameter $d_2$, the diameter $d_1$ having a value less than the value of the diameter $d_2$.

8. The spindle of claim 7, wherein the diameter $d_2$ has a value in the range of about 1.0 mm to about 2.0 mm.

9. The spindle of claim 7, wherein said spindle tip and the spinning tube are operatively connected in a region of connection, the spindle tip having an annular gap located in said region of connection so that said first and second injector tubes do not have to be arranged in exact alignment.

10. The spindle of claim 7, wherein said spindle aperture has a diameter $d_E$, said diameter $d_E$ and diameter $d_1$ defining a ratio $$\frac{d_1}{d_E},$$

the ratio $$\frac{d_1}{d_E}$$

having a value in the range of about 0.3 to about 0.8.

11. A method for piecing after an interruption in a spinning process in a spindle comprising a yarn guide duct having a spindle aperture and an end in which a free yarn end is guided in reverse through said spindle aperture, the method comprising:

injecting compressed air into the vicinity of the spindle aperture without movement of the yarn guide duct;

said injection of compressed air causing a suction action arising at the end of said yarn guide duct;

said suction action causing the free yarn end to be guided in reverse.

12. The method of claim 11, wherein said injection of compressed air blows said free yarn end out of said spindle aperture.

13. A method for piecing after an interruption in a spinning process in a spindle for a spinning station, the spindle comprising a yarn guide duct having a spindle aperture and an end, the spindle further comprising an injector duct configured to inject compressed air in the vicinity of the spindle aperture; the method comprising:

injecting compressed air into the vicinity of the spindle aperture without movement of the yarn guide duct;

said injection of compressed air causing a suction action arising at the end of said yarn guide duct;

said suction action causing the free yarn end to be guided in reverse.

14. The method of claim 13, wherein said injector duct is located at a distance D from said spindle aperture, the distance D having a value of about 8 mm or less.

15. The method of claim 13, wherein said spindle defines an axis and said injector duct defines an axis, the axis of said injector duct being inclined at an angle β with respect to the axis of said spindle, the angle β having a value in the range of about 5° to about 20°.

16. The method of claim 15, wherein the axis of said spindle intersects the axis of said injector duct in said spindle aperture.

17. The method of claim 13, wherein said injector duct comprises a first injector tube and a second injector tube and said spindle comprises a spindle tip and a spinning tube operatively connected to said spinning tip;

said spindle aperture and said first injector tube are located in said spindle tip and said second injector tube is located in said spinning tube.

18. The method of claim 17, wherein said first injector tube has a diameter $d_1$ and said second injector tube has a diameter $d_2$, the diameter $d_1$ having a value less than the value of the diameter $d_2$.

19. The method of claim 18, wherein the diameter $d_2$ has a value in the range of about 1.0 mm to about 2.0 mm.

20. The method of claim 18, wherein said spindle aperture has a diameter $d_E$, said diameter $d_E$ and diameter $d_1$ defining a ratio $$\frac{d_1}{d_E},$$

the ratio $$\frac{d_1}{d_E}$$

having a value in the range of about 0.3 to about 0.8.

* * * * *